US010272671B2

(12) United States Patent
Wang et al.

(10) Patent No.: US 10,272,671 B2
(45) Date of Patent: Apr. 30, 2019

(54) ISOLATING FAILED RESISTORS

(71) Applicant: Hewlett-Packard Development Company, L.P., Houston, TX (US)

(72) Inventors: Stanley J. Wang, Albany, OR (US); Terry McMahon, Albany, OR (US); Mohammed S. Shaarawi, Corvallis, OR (US); Donald W. Schulte, Albany, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/747,688

(22) PCT Filed: Oct. 8, 2015

(86) PCT No.: PCT/US2015/054697
§ 371 (c)(1),
(2) Date: Jan. 25, 2018

(87) PCT Pub. No.: WO2017/062012
PCT Pub. Date: Apr. 13, 2017

(65) Prior Publication Data

US 2018/0222181 A1 Aug. 9, 2018

(51) Int. Cl.

| | |
|---|---|
| ***B41J 2/14*** | (2006.01) |
| ***B41J 2/21*** | (2006.01) |
| ***B41J 2/045*** | (2006.01) |
| ***B41J 2/165*** | (2006.01) |

(52) U.S. Cl.
CPC ..... *B41J 2/04541* (2013.01); *B41J 2/0451* (2013.01); *B41J 2/0455* (2013.01); *B41J 2/0458* (2013.01); *B41J 2/04508* (2013.01); *B41J 2/14072* (2013.01); *B41J 2/16517* (2013.01); *B41J 2/2139* (2013.01)

(58) Field of Classification Search
None
See application file for complete search history.

(56) References Cited

U.S. PATENT DOCUMENTS 5,025,300 A * 6/1991 Billig ..... H01L 23/5258 257/529
5,363,134 A 11/1994 Barbehenn et al.
6,037,831 A 3/2000 Watrobski et al.
(Continued)

FOREIGN PATENT DOCUMENTS

EP 1080897 3/2001
EP 1211078 6/2002

OTHER PUBLICATIONS

Wikipedia Article: Refractory Metals, retrieved on Sep. 3, 2018, Section: Definition (Year: 2018).*
(Continued)

*Primary Examiner* — Lisa Solomon
(74) *Attorney, Agent, or Firm* — HP Inc.—Patent Department

(57) ABSTRACT

A system for isolating a failed resistor in a liquid dispensing system including a fusible links described. The system includes drive circuitry to drive a voltage supply to a resistor. The fusible link is disposed between a field effect transistor (FET) and the resistor. The fusible link is to fuse apart upon failure of the resistor.

13 Claims, 7 Drawing Sheets

(56) References Cited

U.S. PATENT DOCUMENTS

| | | | | |
|---|---|---|---|---|
| 6,067,219 | A * | 5/2000 | Armstrong | H02H 3/087 361/101 |
| 8,573,750 | B2 | 11/2013 | Hoisington et al. | |
| 2005/0097385 | A1 | 5/2005 | Ahne et al. | |
| 2005/0145982 | A1 | 7/2005 | Chavarria | |
| 2014/0184700 | A1 | 7/2014 | Sakurai et al. | |

OTHER PUBLICATIONS

IP.com search (Year: 2018).*
"HD—Nozzle isn't Heating", Technical Assistance, 2015, 4 pages, https://airwolf3d.freshdesk.com/support/solutions/articies/5000652258-nozzle-isn-t-heating.
International Search Report and Written Opinion for International Application No. PCT/US2015/054697 dated Jun. 30, 2016, 13 pages.

* cited by examiner

ISOLATING FAILED RESISTORS

BACKGROUND

Printing devices contain a number of printheads used to dispense ink or another jettable fluid onto a print medium. The printheads include a number of dies that are precision dispensing devices that precisely dispense the jettable fluid to form an image on the print medium. The jettable fluid may be delivered via a fluid slot defined in the print head to an ejection chamber beneath a nozzle. Fluid may be ejected from the ejection chamber by, for example, heating a resistive element. The ejection chamber and resistive element form the thermal fluid ejection device of a thermal inkjet (TIJ) printhead. The printing devices may, however, use any type of digital, high precision liquid dispensing system, such as, for example, two-dimensional printing systems, three-dimensional printing systems, digital titration systems, and piezoelectric printing systems, among other types of printing devices.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
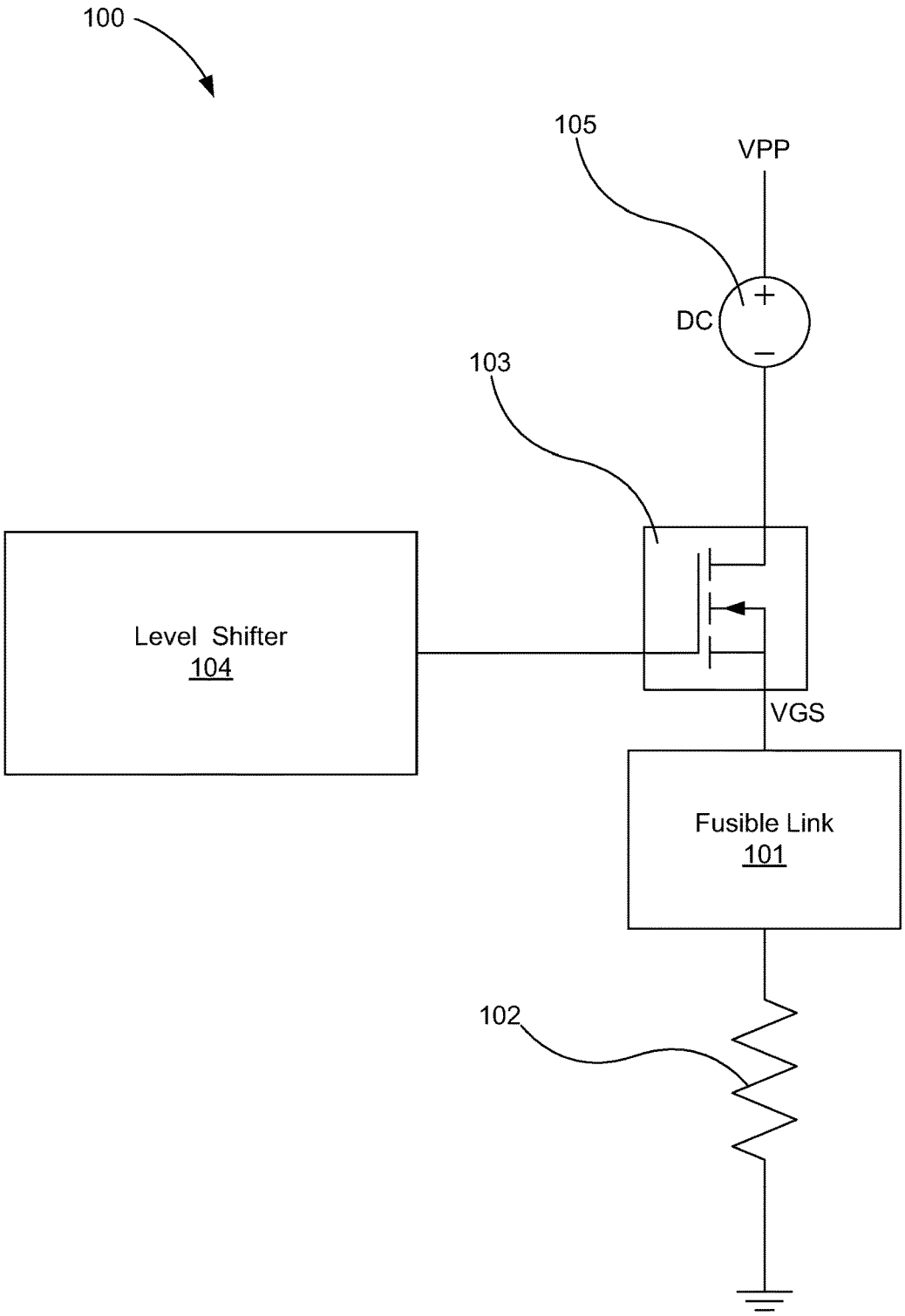
FIG. 1 is a diagram of thermal ink jet (TIJ) resistor circuit for failure-isolation of a thermal ink jet (TIJ) resistor, according to one example of the principles described herein.

In some thermal inkjet printing devices, the resistive heating elements used to create ink ejection events from nozzles may fail for a number of reasons. In one example, the resistive heating elements may fail due to defects within the resistive heating elements or associated circuitry. These defects may cause the materials used in the resistive heating elements or associated circuitry to fail over successive firing events. After failure, the resistive heating elements or associated circuitry may continue to attempt a firing event based on electrical signals continuing to be sent to the failed resistive heating element. In this state, although the resistive heating elements and its associated circuitry are not ejecting jettable fluid from the nozzles of the printhead, electricity is traveling through the failed resistive heating elements and associated circuitry. In this situation, arcing and additional shorting of circuitry within the drive circuitry of the resistive heating elements and within the resistive heating elements themselves may occur.

While thermal inkjet (TIJ) devices are described throughout the examples herein, any type of digital, high precision liquid dispensing system may utilize these examples. For example, the printhead may include any two-dimensional (2D) printing elements or devices, any three-dimensional (3D) printing elements or devices, digital titration elements or devices, piezoelectric printing elements or devices, other types of digital, high precision liquid dispensing system, or combinations thereof. These various types of liquid dispensing systems may dispense a myriad of types of liquids including, for example, inks, 3D printing agents, pharmaceuticals, lab fluids, and bio-fluids, among other dispensable liquids. The 3D printing agents may include, for example, polymers, metals, adhesives, 3D inks, among others.

Due to the close proximity of other resistive heating elements and other drive circuits, the failure of a resistive heating element may propagate to feed traces of the resistive heating element and to adjacent resistive heating elements and their respective drive circuitry. These resistive heating elements may then fail due to the arcing and shorting of the first resistive heating element. In this manner, the failure of a resistive heating element may cascade to a number of other resistive heating elements, causing significant damage to an inkjet printhead and severely reducing or destroying the printhead's ability to properly eject jettable fluid.

A number of electrical clamps in a high side switch TIJ circuit may be employed to mitigate propagation of the undesirable effects of the failed resistive heating element(s). However, the clamps occupy a very large amount of area within the printhead circuitry when a goal is to reduce slot pitch within the printhead or reduce the size of the printhead as a whole. Further, the clamps do not disable the firing of fail or shorted out resistive heating elements. Thus, in the case of failed resistive heating elements shorting to ground, high electrical currents may be realized along with undesirable voltage bias on, for example, cavitation plates within the printhead.

Examples described herein provide a system for isolating a failed resistor in a liquid dispensing system, and includes drive circuitry to drive a voltage supply to a TIJ resistor, and a fusible link disposed between a field effect transistor (FET) and the resistor, the fusible link to fuse apart upon failure of the resistor. The opening of the fusible link electronically isolates the resistor from the drive circuitry of the resistor. In one example, the system does not include a gate clamp.

In one example, the fuse may be made of polycrystalline silicon. In another example, the fuse may be made of tungsten silicon nitride (WSiN). In one example, the isolation to the resistor is performed without intervention from system firmware or a processing device.

The system may further include a controller to, upon opening of the fusible link, execute a number of nozzle replacement techniques to compensate for the failed resistor. The controller may also, upon opening of the fusible link, execute computer readable computer code to detect the failure of the resistor, and disable voltage to the FET. In one example, the FET is a laterally diffused metal oxide semiconductor (LDMOS) FET Examples described herein provide a resistor circuit in a liquid dispensing system for failure-isolation of a resistor including a field effect transistor (FET), a resistor electrically coupled to the FET, and a fusible link disposed between the FET and the resistor, the fusible link to fuse open upon failure of the resistor. In one example, the resistor circuit includes a high side switch (HSS) configuration. The fusible link disconnects the resistor from the FET before a gate to source voltage (VGS) exceeds a gate breakdown voltage of the FET. In one example, the fusible link comprises a bow tie shape.

Examples described herein provide a nozzle array for isolating a failed in a liquid dispensing system resistor. The nozzle array includes a plurality of circuits electrically coupled to a number of nozzles. Each circuit includes a fusible link disposed between a field effect transistor (FET) and a resistor. The fusible link fuses open upon failure of the resistor to electrically isolate the resistor. The opening of the fusible link electronically isolates the resistor from a number of other resistors within the nozzle array.

As used in the present specification and in the appended claims, the term "fuse" is meant to be understood broadly as any type of low resistance resistor that acts as a sacrificial device to provide overcurrent protection, of either a load or source circuit. A fuse includes a metal wire or strip that melts, vaporizes, or is otherwise destroyed when too much current flows through it, interrupting the circuit that it connects. Short circuits, overloading, mismatched loads, or device failure are reasons for excessive current.

Further, as used in the present specification and in the appended claims, the term "clamp" is meant to be understood broadly as any electrical device that limits voltage between a gate and a source of a field effect transistor (FET). The clamp, in one example, reduces or eliminates snapback failures as a resistor shorts out to ground. However, a clamp still allows shorted resistors to energize causing the above-describe damage to surrounding resistive heating elements and other circuitry.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1 is a diagram of thermal ink jet (TIJ) resistor circuit (100) for failure-isolation of a thermal ink jet (TIJ) resistor (102), according to one example of the principles described herein. A plurality of TIJ resistor circuits (100) may be included within a TIJ printhead to create an array of TIJ resistor circuits (100) that eject jettable fluid from an array of nozzles. The TIJ resistor circuit (100) may include the TIJ resistor (102). The TIJ resistor (102) is a resistive heating element that, when activated, causes a vapor bubble to be formed in a firing chamber of the inkjet printhead. Ink or another jettable fluid is projected through an orifice called a nozzle by the repetitive high-speed collapse of the vapor bubble created by the resistive heating of the TIJ resistor (102). The implosion or cavitation of the bubbles may erode portions of the TIJ printhead that may, in turn, cause failure of the TIJ resistor (102). In order to reduce or eliminate the failure of the TIJ resistor (102), a fusible link (101) is included within the TIJ resistor circuit (100) to isolate the failed TIJ resistor (102) from other electrical circuits within the inkjet printhead.

A transistor (103) and a level shifter (104) are included in the TIJ resistor circuit (100) to drive energy provided by an electrical power supply voltage (VPP) (105) to the TIJ resistor (102). The transistor may be any type of transistor including, for example, a field effect transistor (FET). In one example, the FET may be a laterally diffused metal oxide semiconductor (LDMOS) drive FET. The level shifter (104) may be any device that shifts the magnitude of the signal levels to effectively control the transistor (103) such that the transistor (103) applies a driver output signal to the TIJ resistor (102). In other words, the level shifter (104) brings the gate of the transistor (104) up to the VPP (105) in order to put the full VPP (105) across the TIJ resistor (102) for a firing event. In this manner, the transistor (103) is responsive to the transmitted signal from the level shifter (104) for applying a driver output signal to the TIJ resistor (102) to provide energy from to the TIJ resistor (102) in order to bring about a jettable fluid firing event. Thus, the transistor (103) makes the TIJ resistor circuit (100) a high-side switch (HSS). An HSS is a circuit or a group of circuits that are controlled by an external enable signal such as the signal from the level shifter (104). The transistor (103) is located on the high voltage side of the TIJ resistor (102). An HSS connects or disconnects a power source such as the VPP (105) to a given load such as the TIJ resistor (102). Compared to a low-side switch, a high-side switch sources current to the load, while a low-side switch connects or disconnects the load to ground, and therefore sinks current from the load.

In one example, the level shifter (104) operates at approximately 5 volts (V) to 5.5V logic voltage, and the VPP (105) provides approximately a 30V firing voltage. The examples described herein do not include a clamp. A clamp is any device that limits voltage between the gate and the source of the transistor (103). The clamp ensures that if an insufficient logic voltage from the level shifter (104) is not present, a threshold voltage (e.g., approximately 7V) below the gate voltage (VGS) is maintained. If the TIJ resistor (102) fails in a circuit that includes a clamp, 30V are present at the gate of the transistor (103), and the source is close to ground. Because of the short caused by the failure of the TIJ resistor (102), the gate sees 30V voltage level. However, the gate's oxide may withstand, for example, approximately 20V before the gate's oxide breaks down and is destroyed. This upper voltage level may be referred to as the gate oxide breakdown voltage. In this situation, the gate's oxide may be destroyed if the clamp were not present, potentially resulting in a catastrophic failure of the printhead die. However, a clamp occupies a very large amount of area within the printhead circuitry. In some examples, the clamps within a number of resistor circuits may take up approximately 10% to 25% of a width of a printhead. This amount of area is compounded since a clamp is present for each TIJ resistor (102). When a goal is to reduce slot pitch within the printhead or reduce the size of the printhead as a whole, use of a number of clamps within the printhead die significantly increases the size of the printhead in order to make the clamps part of the printhead. Further, the clamps do not disable the firing of fail or shorted out resistive heating elements.

The resistor circuit (100) also includes a fusible link (101). The fusible link (101) is placed in series between the transistor (103) and the TIJ resistor (102). Further, the fusible link (101) is placed on the high side of the TIJ resistor (102) and the source side of the transistor (103). The fusible link (101) may be made of any material that fuses open upon the failure of the TIJ resistor (102). In one example, the fusible link (101) may be made of a polycrystalline silicon, sometimes referred to as polysilicon or poly-Si. Polycrystalline silicon is a high purity, polycrystalline form of silicon produced from metallurgical grade silicon by a chemical purification process, called the Siemens process. This process involves distillation of volatile silicon compounds, and their decomposition into silicon at high temperatures. In another example, the fusible link (101) may be made of tungsten silicon nitride (WSiN).

Figure 2:
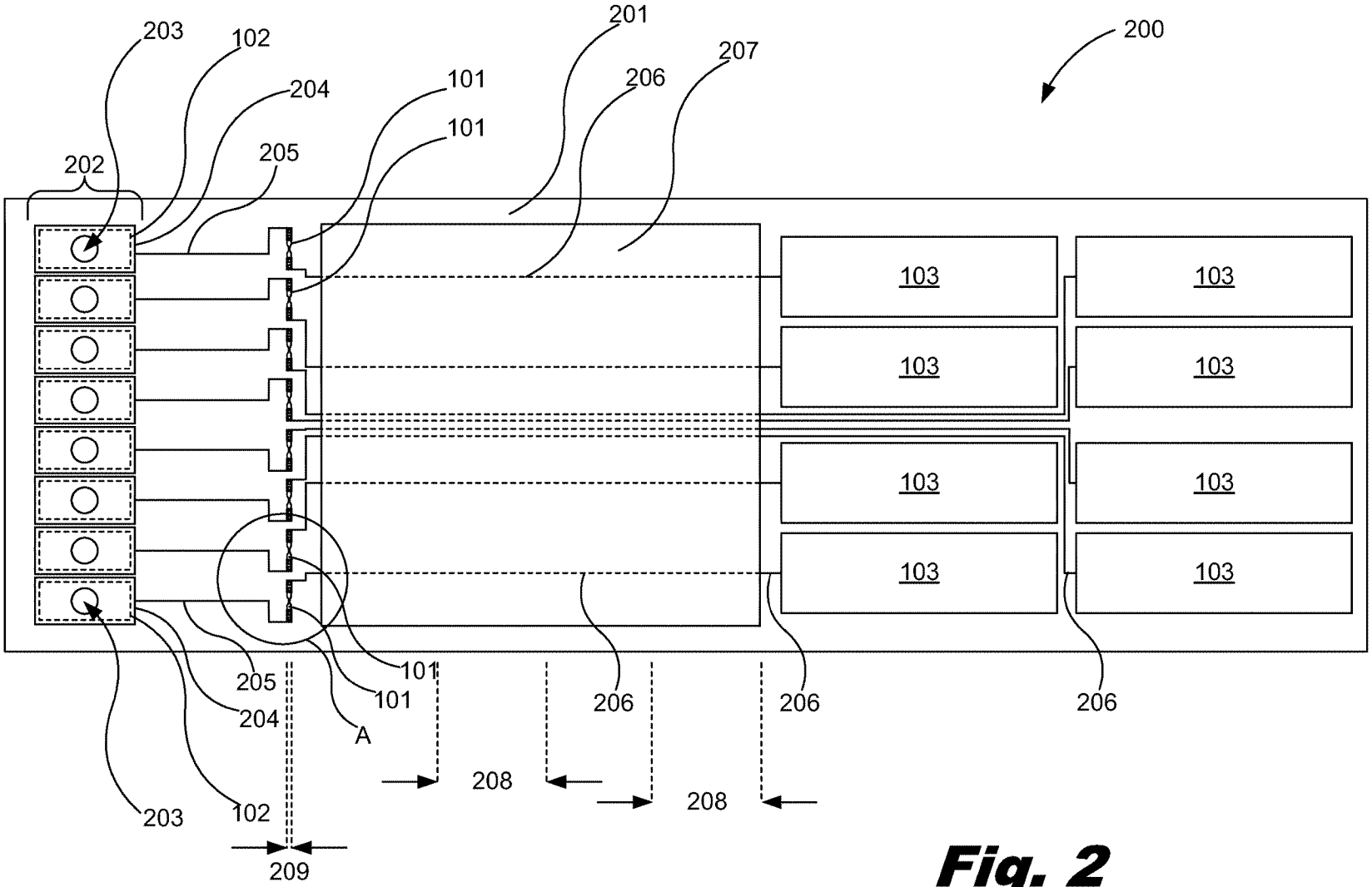
FIG. 2 is a circuit layout of a system for isolating a failed thermal ink jet (TIJ) resistor, according to one example of the principles described herein.

FIG. 2 is a circuit layout of a system for isolating a failed thermal ink jet (TIJ) resistor, according to one example of the principles described herein. FIG. 2 depicts a printhead (200) including a plurality of resistor circuits (100) described above in connection with FIG. 1. The resistor circuits (100) are arranged on a printhead die substrate (201). The circuit layout of FIG. 2 is embodied in a single integrated circuit. In one example, the circuit layout is a micro-electro-mechanical system (MEMS) solid state integrated circuit. In this manner, the integrated circuit, as included in a printing device, takes up much less space as compared to, for example, a piezoelectric printing devices that use piezoelectric elements to eject jettable fluid. In piezoelectric printing devices, all electrical elements are not integrated into a single integrated circuit because it is not possible to build a silicon wafer with a piezoelectric device bonded thereto in a single integrated form. The significantly small size of the TIJ integrated circuit has many advantages including a decrease in manufacturing costs due to less materials being used, as well as the ability to manufacture a printing device with a smaller footprint.

The resistor circuits (100) include a number of TIJ resistors (102) aligned in a column (202), and a number of nozzles (203) defined in a corresponding number of firing chambers (204) in which each of the TIJ resistors (102) are located. In FIG. 2, the TIJ resistors (102) are indicated by the dashed lines as being inside the firing chambers (204).

A number of first traces (205) electrically couple the TIJ resistors (102) to the fusible links (101). One fusible link (101) is provided for each TIJ resistor (102). A number of second traces (206) are provided to couple the fusible links (101) to their respective transistors (103). The first traces (205) are coupled to a first end of each of the fusible links (101), and the second traces (206) are coupled to a second end of each of the fusible links (101).

Also depicted in FIG. 2 is a fluid flow section (207) where channels are placed for ink or other jettable fluid to be transferred from an ink slot to the individual firing chambers (204). The fluid flow section (207) is included in FIG. 2 to demonstrate the relative spaces (208) and positions within the printhead (200) that a number of clamp devices may occupy if the fusible links (101) were not included in the examples described herein. If a number of clamp devices were included in the printhead (200), the space within the printhead (200) would be increased to include the relative spaces (208) to make space for the clamping devices. As described above, if a goal of printhead fabrication is to reduce the size of the printhead (200) overall, and to simplify the electrical circuitry within the printhead (200), then inclusion of a number of clamp devices for each of the TIJ resistors (102) would be contrary to this goal. This is especially in light of the significantly less space (209) the fusible links (101) occupy within the printhead (200). In some examples, the fusible links (101) occupy space within the printhead (200) that is already occupied by, for example, a portion of an electrical trace. In this example, the fusible links (101) do not require any additional space within the printhead (200). Thus, the use of the fusible links (101) instead of clamping devices significantly reduces the space used within a printhead (200), reduces the size of the printhead (200), and significantly simplifies the design of the resistor circuits (100) within the printhead (200), renders the need for the clamping devices obsolete, and reduces the cost of manufacturing the printhead (200) significantly.

Figure 3:
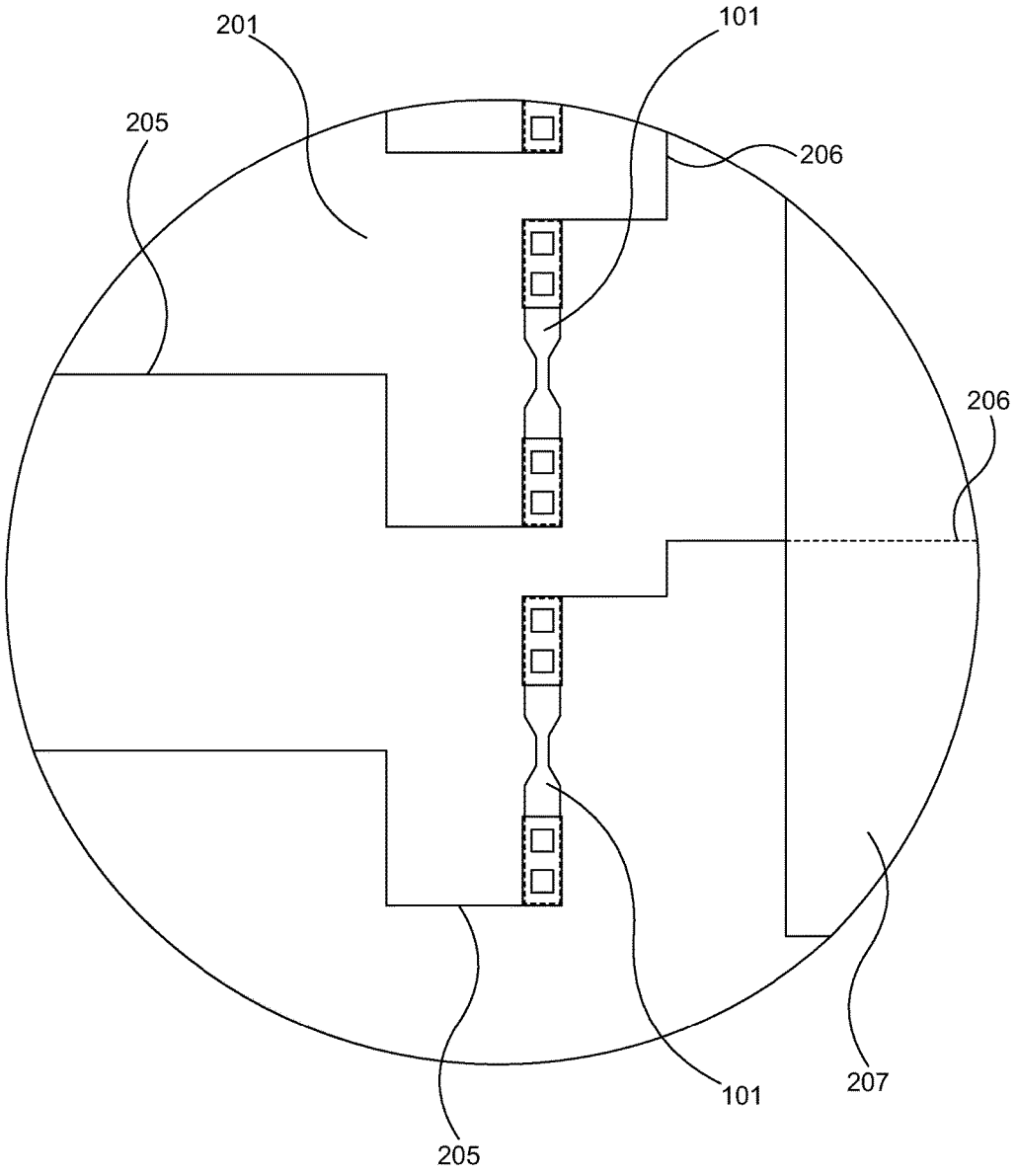
FIG. 3 is a diagram of the system of FIG. 2 depicting the portion within circle A of FIG. 2, according to one example of the principles described herein.
Figure 4:
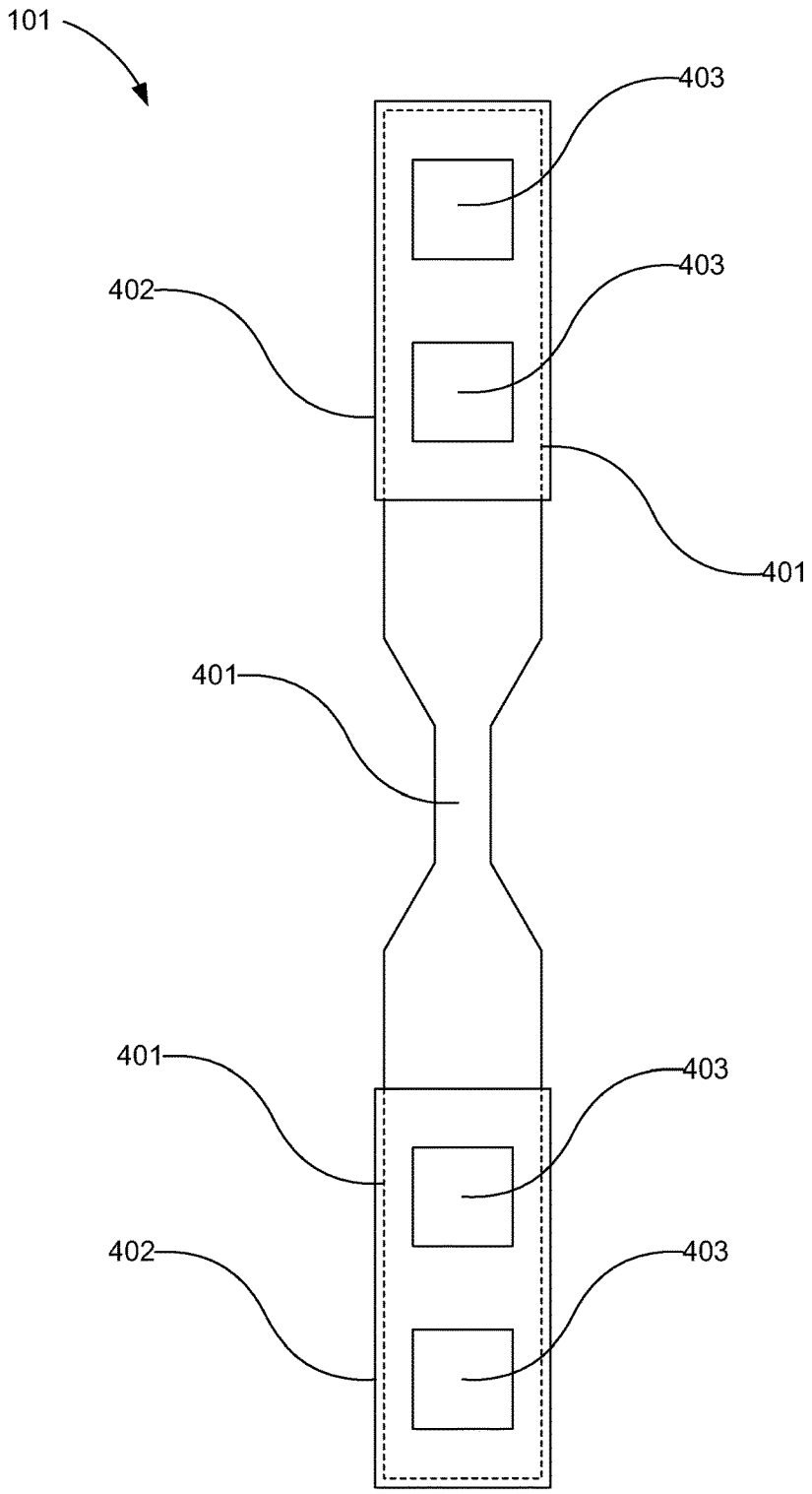
FIG. 4 is a diagram of a fusible ink of the system of FIGS. 2 and 3, according to one example of the principles described herein.

FIG. 3 is a diagram of the system of FIG. 2 depicting the portion within circle A of FIG. 2, according to one example of the principles described herein. Further, FIG. 4 is a diagram of a fusible ink (101) of the system of FIGS. 2 and 3, according to one example of the principles described herein. As depicted in FIGS. 3 and 4, the fusible ink (101) includes a bowtie or I-shaped fuse (401). However, the fuse (401) may take any shape. A number of connection pads (402) are coupled to the fuse (401) using a number metal tabs (403). In one example, the fuse (401) may directly couple to the first traces (205) and second traces (206). In another example, the connection pads (402) and metal tabs (403) may be used to couple the fuse (401) to the first traces (205) and second traces (206) through a via defined in a number of layers within the printhead die substrate (201).

Figure 5:
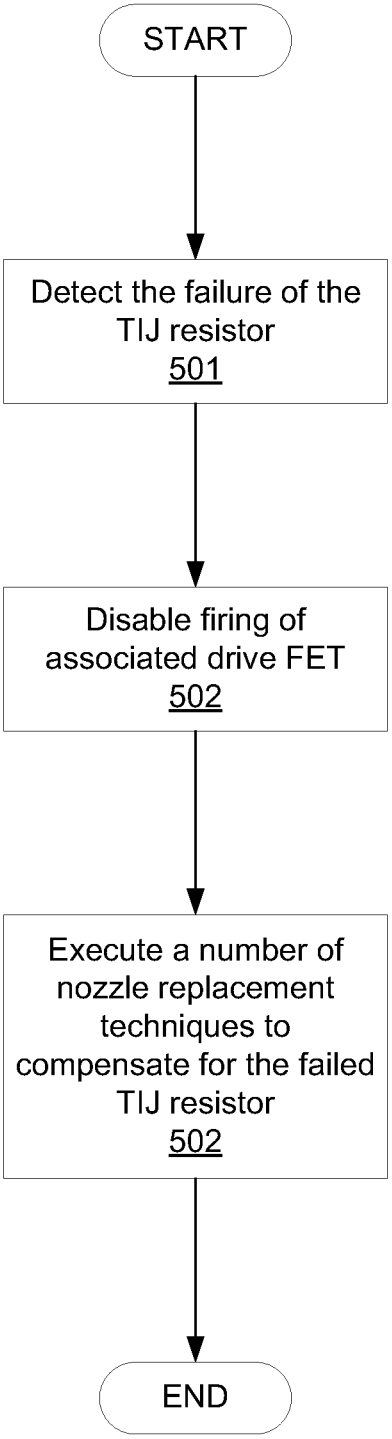
FIG. 5 is a flowchart showing a method of addressing a failure of a thermal inkjet (TIJ) resistor, according to one example of the principles described herein.

FIG. 5 is a flowchart showing a method of addressing a failure of a thermal inkjet (TIJ) resistor, according to one example of the principles described herein. The method of FIG. 5 may be used to isolating a failed thermal ink jet (TIJ) resistor. The method may begin by detecting (block 501) a failure of a TIJ resistor (102). The detection may be made by, for example, a controller of an associated printing device, or may be made by, for example, a scanning device that detects defects within a printed image. Once the failure of the TIJ resistor (102) occurs, the fuse (401) of the fusible link (101) fuses open, and isolates the TIJ resistor (102) from other circuitry within the resistor circuit (100).

Once the fuse (401) of the fusible link (101) fuses open, the controller of the printing device may disable (block 502) firing of a transistor (103) (i.e. FET) associated with the TIJ resistor (102). In this manner, voltage to the transistor (103) may be disabled. Further, the controller of the printing device may execute (block 502) a number of nozzle replacement techniques to compensate for the failed TIJ resistor (102). One such nozzle replacement technique is stitching. Stitching of the nozzles may be accomplished, in one example, by timing the firing of any overlapping nozzles such that the combined firing of ejection fluid from the overlapped nozzles does not eject any more or less jettable fluid than other non-overlapping nozzles.

Figure 6:
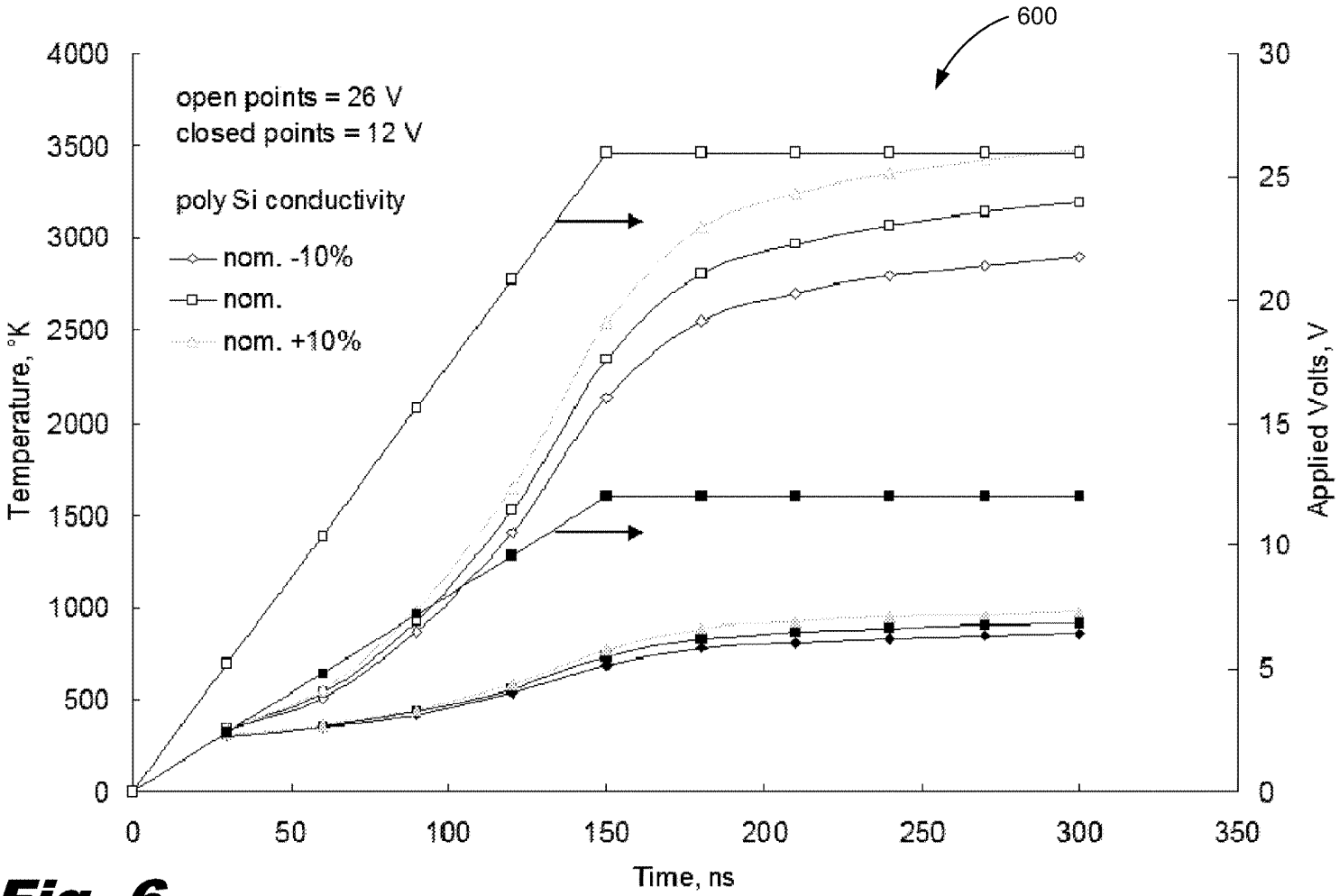
FIG. 6 is a chart modeling characteristics of a polycrystalline silicon fuse, according to one example of the principles described herein.

FIG. 6 is a chart (600) modeling characteristics of a polycrystalline silicon fuse, according to one example of the principles described herein. The behavior of a polycrystalline silicon fuse (101) described herein is modeled. The chart (600) depicts the temperature of a polycrystalline silicon fuse (101) as a function of time (in nanoseconds) and volts applied to the polycrystalline silicon fuse (101). As depicted in the chart (600), the vaporization temperature of a 1 μm by 4 μm sized polycrystalline silicon fuse (101) is depicted. It is noted that the polycrystalline silicon vaporization temperature is approximately 1687 Kelvin. Other nominal values are provided in the chart (600).

Figure 7:
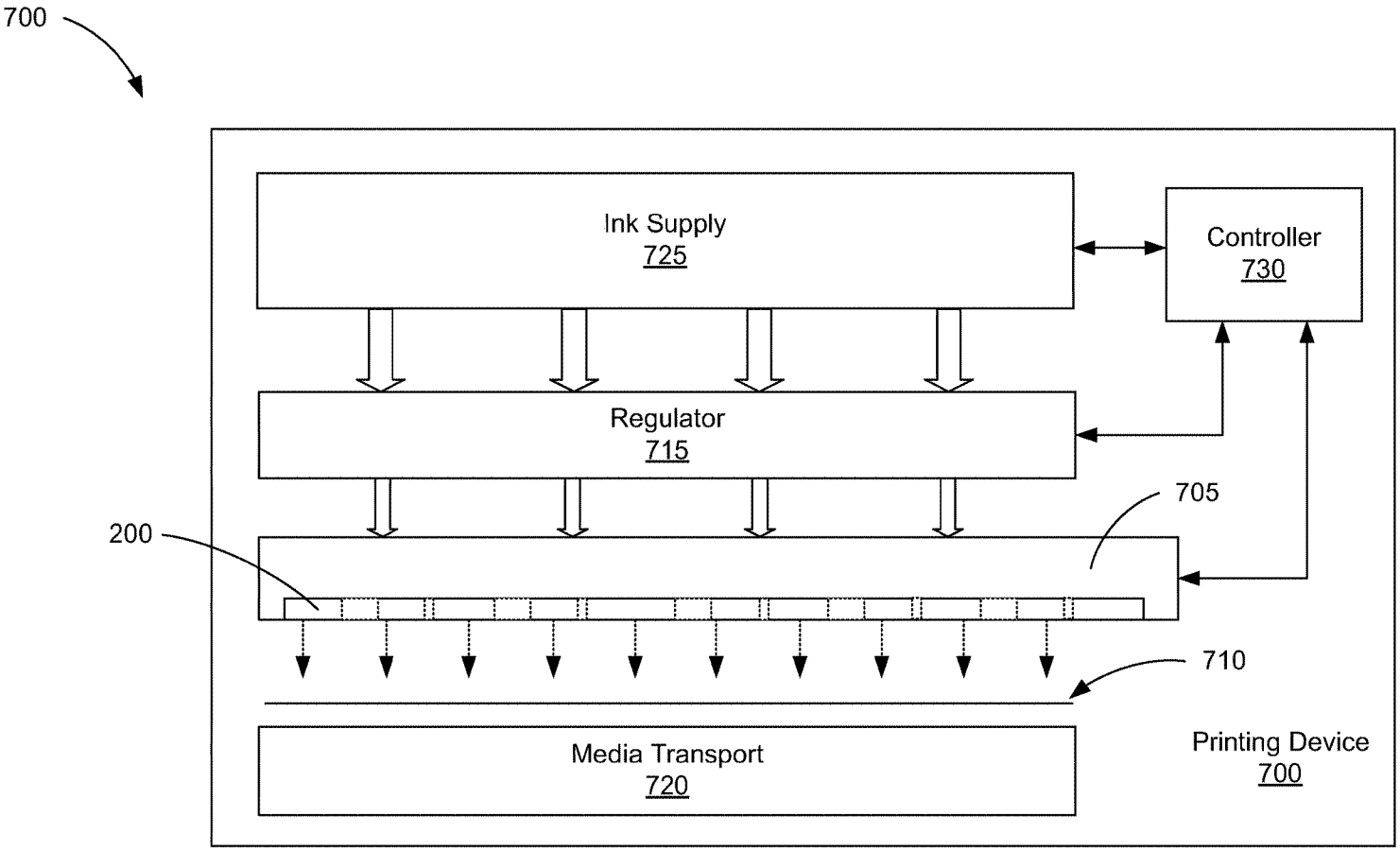
FIG. 7 is a block diagram of a printing device, according to one example of the principles described herein.

FIG. 7 is a block diagram of a printing device, according to one example of the principles described herein. FIG. 7 includes a printing device (700) including a print bar (705) including a number of printheads (200) according to one example of the principles described herein. The printing device (700) may include a print bar (705) that, in one example, spans the width of a print media (710). The printer (700) may further include flow regulators (715) associated with the print bar (705); a media transport mechanism (720), ink or other jettable fluid supplies (725), and a printer controller (730). The controller (730) may represent the programming, processor, and associated data storage device(s), and the electronic circuitry and components needed to control the operative elements of the printing device (700). The print bar (705) may include an arrangement of printhead dies (200) for dispensing jettable fluid onto a sheet or continuous web of paper or other print media (710). The print bar (705) in FIG. 7 may include multiple molded printhead dies (735) spanning print media (710). However, different print bars (705) are contemplated in the present specification that may include more or less printhead dies (735) and may be fixed to a page wide array bar as depicted in FIG. 7 or on a movable print cartridge.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the controller (730) of the printing device (700) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures a system for isolating a failed thermal ink jet (TIJ) resistor includes a fusible link. The fusible link is disposed between a field effect transistor (FET) and the TIJ resistor, the fusible link to fuse apart upon failure of the TIJ resistor. The fusible link fuses open upon failure of the TIJ resistor. This system may have a number of advantages, including (1) reduction in cost of manufacturing; (2) elimination of a number of elements within a printhead die including, for example, a clamp; (3) simplification of electrical circuitry within a printhead; (4) elimination of propagation of the failure of a TIJ resistor to other circuits and other TIJ resistors; and (5) provisioning of space that would otherwise be taken up by clamps to be used for other circuitry including, for example, additional firing resistors and their respective circuitry, among other advantages.

The preceding description has been presented to illustrate and describe examples of the principles described. This description is not intended to be exhaustive or to limit these principles to any precise form disclosed. Many modifications and variations are possible in light of the above teaching.

What is claimed is:

1. A system for isolating a failed resistor in a liquid dispensing system comprising:

drive circuitry to drive a voltage supply to a resistor; and a fusible link disposed between a field effect transistor (FET) and the resistor, the fusible link to fuse open upon failure of the resistor to electronically isolate the resistor from the drive circuitry.

2. The system of claim 1, wherein the fusible link is made of polycrystalline silicon.

3. The system of claim 1, wherein the fusible link is made of tungsten silicon nitride (WSiN).

4. The system of claim 1, wherein the system does not comprise a gate clamp.

5. The system of claim 1, wherein the fusible link is to fuse open to electronically isolate the resistor from the drive circuitry without intervention from system firmware or a processing device.

6. The system of claim 1, further comprising a controller to, upon opening of the fusible link, execute a number of nozzle replacement techniques to compensate for the failed resistor.

7. The system of claim 1, further comprising a controller to, upon opening of the fusible link, execute computer readable computer code to:

detect the failure of the resistor; and disable voltage to the FET.

8. The system of claim 1, wherein the drive circuitry, FET, resistor, and fusible link are integrated into a single integrated circuit.

9. A resistor circuit for failure-isolation of a resistor in a liquid dispensing system comprising:

a field effect transistor (FET);

a resistor electrically coupled to the FET; and a fusible link disposed between the FET and the resistor, the fusible link to fuse open upon failure of the resistor; and wherein the resistor circuit comprises a high side switch (HSS) configuration.

10. The resistor circuit of claim 9, wherein the fusible link disconnects the resistor from the FET before a gate to source voltage (VGS) exceeds a gate breakdown voltage of the FET.

11. The resistor circuit of claim 9, wherein the fusible link comprises a bow tie shape.

12. A nozzle array for isolating a failed resistor in a liquid dispensing system, comprising:

a plurality of circuits electrically coupled to a number of nozzles, each circuit comprising:

a fusible link disposed between a field effect transistor (FET) and a resistor, the fusible link to fuse open upon failure of the resistor to electrically isolate the resistor.

13. The nozzle array of claim 12, wherein the opening of the fusible link electronically isolates the resistor from a number of other resistors within the nozzle array.

* * * * *